United States Patent [19]

Bains

[11] Patent Number: 4,565,340

[45] Date of Patent: Jan. 21, 1986

[54] GUIDED PROJECTILE FLIGHT CONTROL FIN SYSTEM

[75] Inventor: William R. Bains, Lake Elsinore, Calif.

[73] Assignee: Ford Aerospace & Communications Corporation, Detroit, Mich.

[21] Appl. No.: 641,137

[22] Filed: Aug. 15, 1984

[51] Int. Cl.[4] ..... F42B 13/30; F42B 15/16; F42B 15/14

[52] U.S. Cl. ..... 244/3.28; 244/3.1; 244/3.23; 244/3.3; 416/102; 416/151

[58] Field of Search ..... 244/3.28, 3.1, 3.21, 244/3.3, 87, 88, 75 R; 416/151, 31, 102

[56] References Cited

U.S. PATENT DOCUMENTS

| | | | |
|---|---|---|---|
| 3,104,081 | 10/1963 | Arnett | 244/3.21 |
| 3,135,484 | 6/1964 | Herrmann | 244/76 |
| 3,291,418 | 12/1966 | Brunk et al. | 244/3.23 |
| 3,603,533 | 9/1971 | Stripling | 244/3.23 |
| 3,790,103 | 2/1974 | Peoples | 244/3.23 |
| 3,952,970 | 4/1976 | Orzechowski et al. | 244/3.29 |
| 4,076,187 | 2/1978 | Metz | 244/3.23 |
| 4,373,688 | 2/1983 | Topliffe | 244/3.24 |
| 4,426,048 | 1/1984 | Mildren | 244/3.23 |
| 4,438,893 | 3/1984 | Sands et al. | 244/3.21 |

*Primary Examiner*—Deborah L. Kyle
*Assistant Examiner*—Michael Carone
*Attorney, Agent, or Firm*—Edward J. Radlo; Harry G. Weissenberger; Robert D. Sanborn

[57] ABSTRACT

A guidance system for small spinning projectiles which is mechanically simple, has low power requirements, uses relatively unsophisticated electronics, and is capable of withstanding large gas pressures and accelerations. The system uses a one-piece fin assembly which is de-spun so that its guidance fins maintain a constant attitude with respect to the ground. The guidance fins and their hub can be nutated simultaneously and independently in two orthogonal planes by pivoting and translating a single control rod. The hub cooperates with the projectile body to reduce its base drag and thereby extend its range.

9 Claims, 10 Drawing Figures

GUIDED PROJECTILE FLIGHT CONTROL FIN SYSTEM

BACKGROUND OF THE INVENTION

Conventional anti-aircraft guns such as the internationally used Bofors L-70 40 mm automatic gun use spin-stabilized projectiles whose flight path is not controllable after the projectile leaves the gun barrel. Because of aerodynamic drag and weight considerations, the range of these conventional projectiles is only on the order of 4 km. Because of the lack of control over their flight path, a substantial average number of rounds is required per hit, and the projectiles are of limited effectiveness against jinking targets.

A need therefore exists for a guidance system to control the flight path of a spinning projectile which can be used in existing anti-aircraft guns such as the Bofors L-70. Such a guidance system would dramatically reduce the average number of rounds per hit (thereby greatly reducing the problem of supply logistics), and would also make the projectile highly effective against jinking targets.

The need for compatability, in size and shape, with conventional 40 mm ammunition imposes a number of restraints upon the guidance system, as does the need for aerodynamic optimization to maximize the projectile's range. Specifically, the size and shape of that portion of the projectile which protrudes from the cartridge casing cannot be altered, and the guidance system must therefore be placed inside the casing at the aft end of the projectile. This in turn requires the guidance system to withstand not only longitudinal acceleration forces exceeding 50,000 g, but also the tremendous breech pressures which develop within the casing when the round is fired. Consequently, the exposed portions of the guidance system must have a structural integrity which prohibits the use of hinged fins or complex actuating mechanisms.

The projectile has, of necessity, a spin imparted to it by the rifling of the gun barrel. This spin can be reduced but not eliminated. Consequently, prior art devices had to rely on complex, rapid-acting guidance systems to change the attitude of flight control fins in synchronism with the spin of the projectile to achieve a consistent flight path. Such systems required highly sophisticated electronics and large amounts of battery power.

PRIOR ART

Besides the prior art techniques mentioned above and discussed in detail herein, the following U.S. patents are of secondary interest U.S. Pat. Nos.: 4,373,688 (Topliffe); 4,426,048 (Mildren); 4,076,187 (Metz); 3,952,970 (Orzechowski); 3,790,103 (Peoples); 3,603,533 (Stripling); 3,291,418 (Brunk); and 3,135,484 (Herrmann). These references disclose various types of projectile control system, but they do not address the problem involved in this invention.

SUMMARY OF THE INVENTION

The present invention fulfills the above-outlined need and overcomes the described problems by providing an integral, nutating, de-spun guidance fin assembly whose attitude is controlled by a single control shaft which is both pivotable and linearly translatable. The pivoting and translation of the control shaft are accomplished by individual motors located within the body of the projectile.

The de-spinning of the guidance fin assembly greatly simplifies the fin control electronics and sharply reduces the power requirements of the guidance system, as the guidance of a projectile with a de-spun fin assembly usually involves only a single, relatively slow-attitude change. The use of an integral, omnidirectionally nutatable fin assembly provides the structural strength necessary for the guidance system to withstand the firing environment, and makes possible the use of a simple, sturdy control mechanism with a minimum of moving parts.

The nutating guidance fin assembly of this invention also cooperates with the body of the projectile to reduce the base drag, thus substantially improving the range of the projectile.

An additional advantage arises from the provision of the guidance system in that the weight of the projectile is increased without increasing its diameter. Consequently, the muzzle velocity of the projectile is reduced; but after clearing the barrel, the projectile decelerates more slowly, and thus the net effect of the added weight is an increase in range. Taken together, the base drag reduction and the added weight result in a range increase on the order of 50%.

Figure 9:
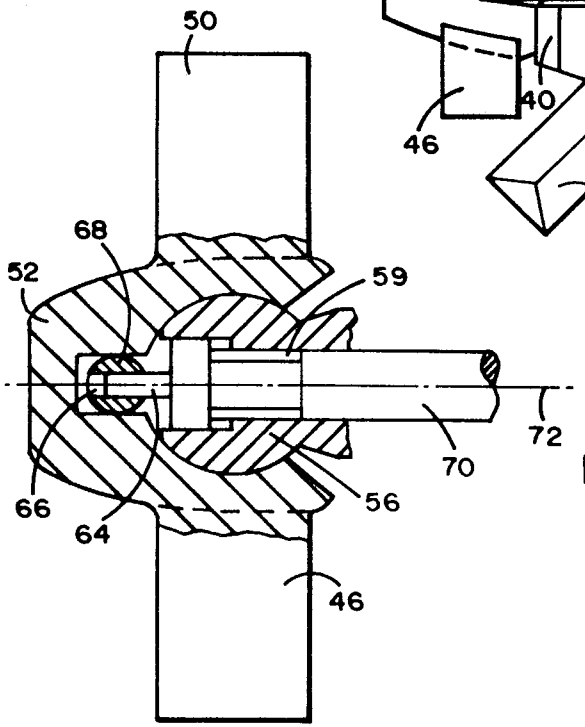
Figure 8:
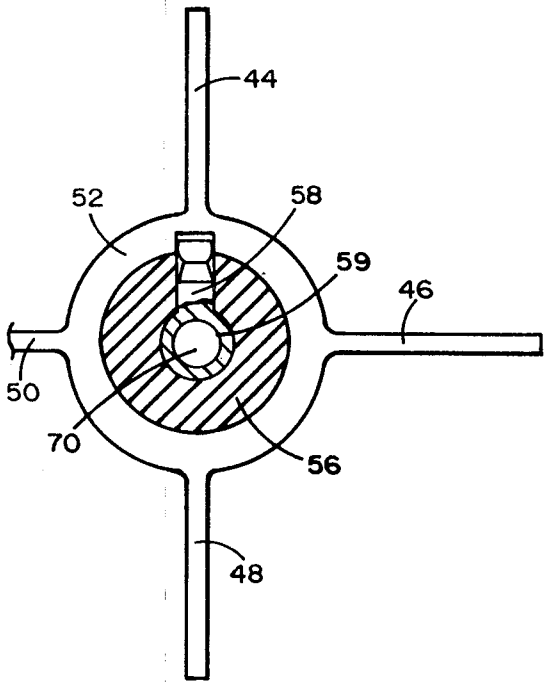

FIGS. *7a* and *7b*, taken together, are a longitudinal vertical section of the aft portion of the inventive projectile;

FIG. 8 is a transverse vertical section along line 8—8 of FIG. *7a*; and FIG. 9 is a horizontal section along line 9—9 of FIG. 8.

DESCRIPTION OF THE PREFERRED EMBODIMENT

Figure 1:
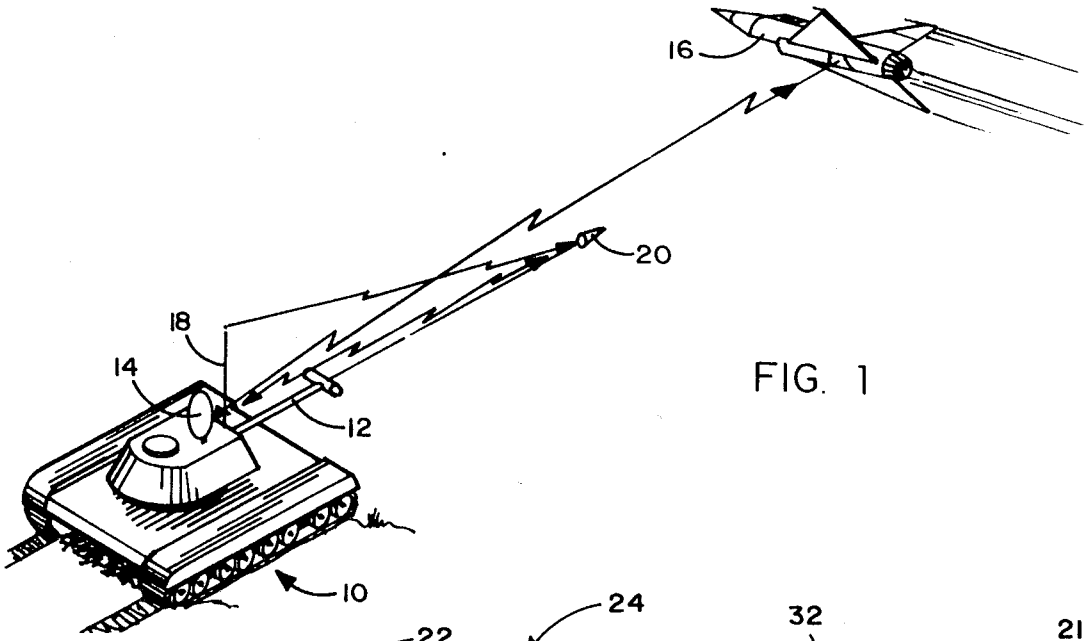
FIG. 1 is a schematic view illustrating an environment in which the invention may be used.

FIG. 1 shows the overall environment in which the projectile of this invention is used. In FIG. 1, 10 designates, as a matter of example, an armored vehicle carrying a conventional antiaircraft gun 12 such as the widely used Bofors L-70 40 mm gun. The gun 12 is adapted to fire a projectile 20. In accordance with the present invention, the projectile 20 is equipped, as will be hereinafter described, with a guidance system including a fin assembly 42 (FIG. *7a*) which allows it to be steered toward the aircraft 16 if the aircraft 16 undertakes jinking maneuvers.

The vehicle 10 is equipped with a conventional tracking system 14 which is capable of tracking an aircraft 16 and predicting its flight path. The tracking system 14 is also capable of tracking the projectile 20 and calculating the course required for the projectile 20 to intercept the target aircraft 16.

Figure 7A:
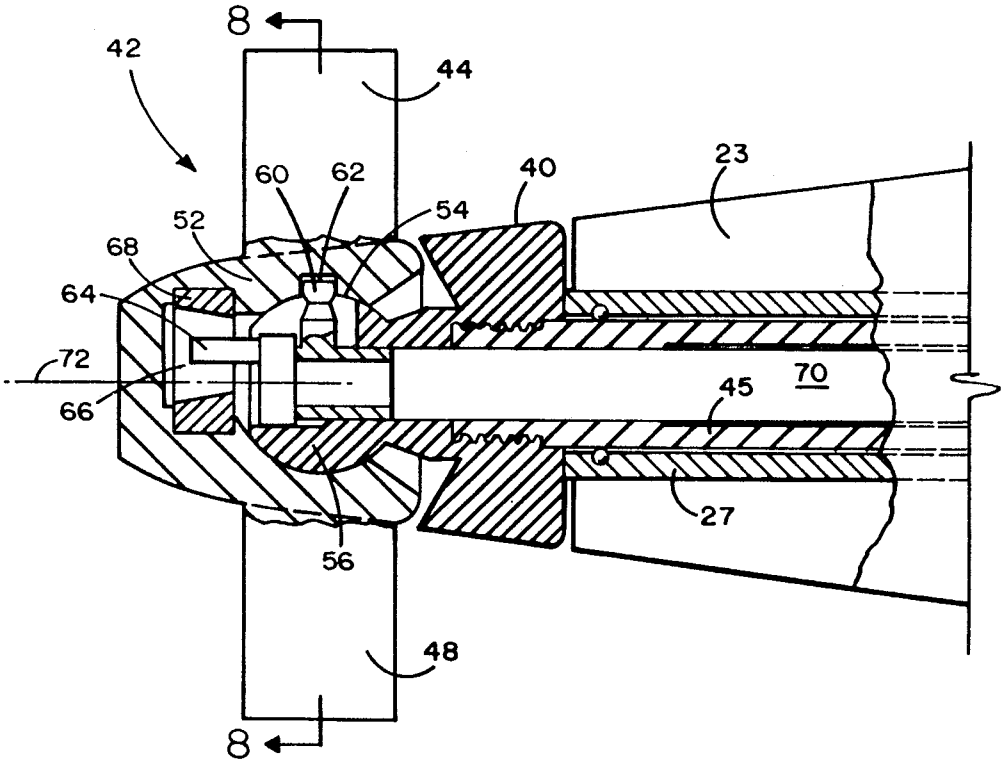
Figure 7B:
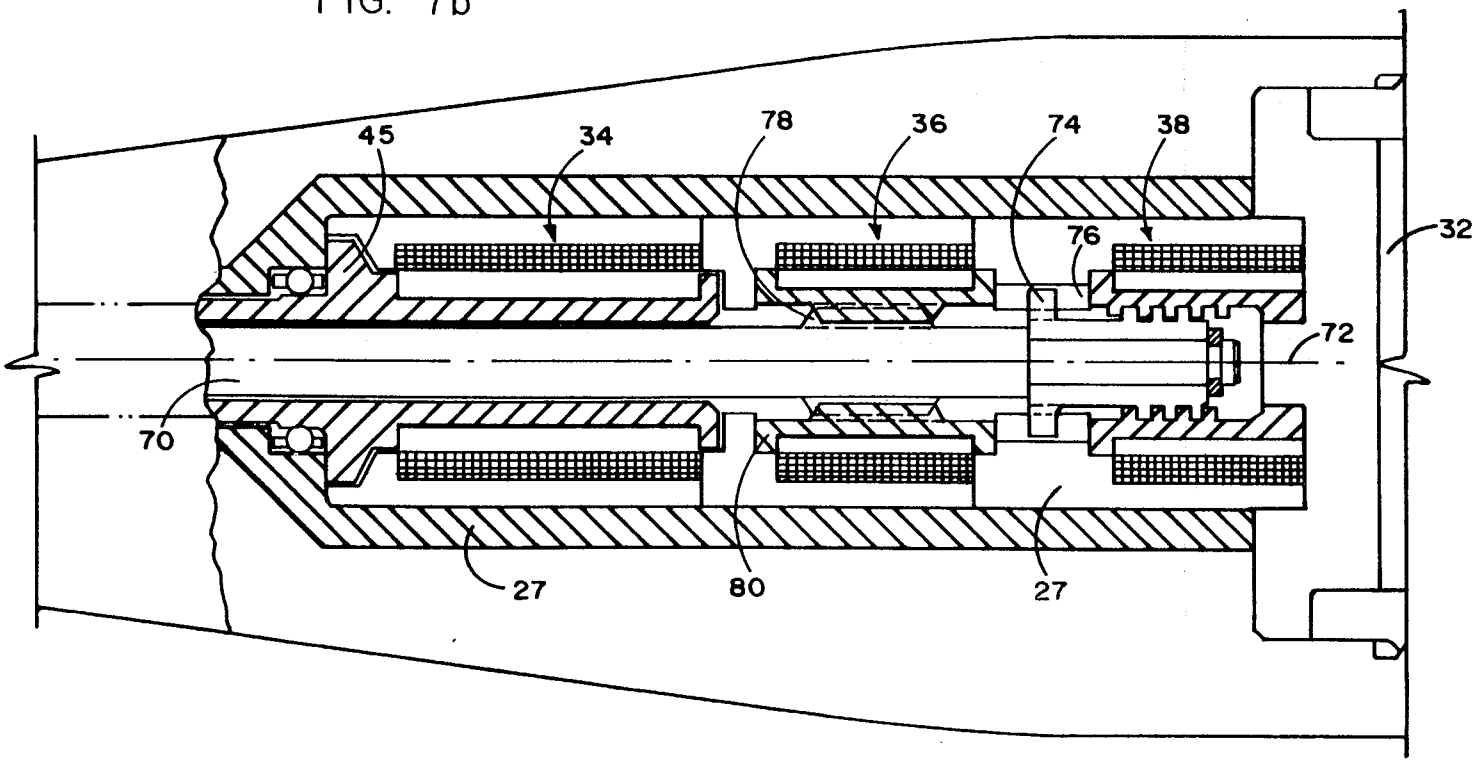

Immediately upon exiting from the barrel of gun 12, each projectile may be individually encoded by a special radio signal so as to make it individually addressable during its flight. A communication antenna 18 on the vehicle 10 may be arranged to transmit a vertically polarized carrier signal from which a conventional polarized receiver in the electronics package 32 (FIG. 7*b*) can derive projectile attitude and spin rate information. Conventional sensors (not shown) may be used internally of the projectile 20 to determine the rotational position of the guidance fin assembly 42 with respect to the projectile body, so that the electronics package 32 will have the information necessary to maintain the fin assembly 42 upright with respect to the ground.

In accordance with the invention, the vehicle 10 may also be equipped with conventional computing equipment (not shown) which processes the tracking information and translates it into commands for the nutation of fin assembly 42. These commands are then encoded and transmitted by the transmitter 18 to the projectile 20.

Figure 2:
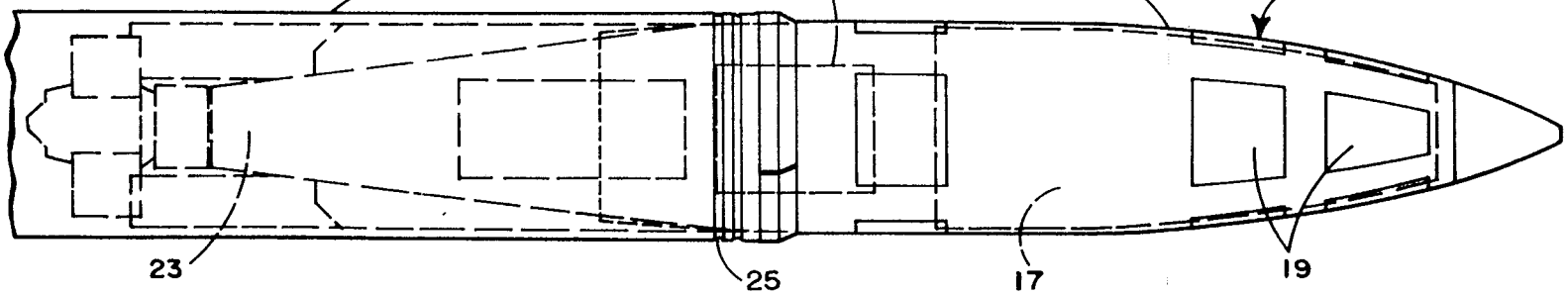
FIG. 2 is a side elevation of a round of ammunition using the inventive projectile.

FIG. 2 is an overall view of a round 24 including a projectile 20 and casing 22, in the form in which it is loaded into the gun 12. The outer dimensions and shape of the round 24 can be identical to the non-guided 40 mm rounds currently in widespread use. As in the corresponding conventional non-guided projectile, the forward portion 21 of the projectile 20 contains the projectile's warhead 17, as well as the electronics package 32. In addition, however, the projectile 20 of this invention carries on its forward portion 21 a set of conformed antennas 19 which enable it, in a conventional manner, to cooperate with a polarized radio signal from the transmitter 18 for the purpose of establishing the projectile's attitude and spin rate.

In this connection, it will be noted that the nose portion of the projectile 20 lying forward of the point 25 where the casing 22 is crimped to it, is preferably essentially identical in size and shape to the corresponding portion of currently used non-guided projectiles. However, the aft portion 23 of guided projectile 20 of this invention (dotted lined) is longer and more tapered than the aft portion of a conventional projectile (dot-dash lines). As a result, the base drag of the projectile 20 is greatly reduced, but the increased length of the projectile requires the use of stabilization fins 26 (FIGS. 3 through 6) as hereinafter described.

The use of stabilization fins 26 theoretically makes spin unnecessary, but a low-velocity spin is nevertheless still desirable for reasons relating to the operation of the conventional data link and guidance electronics which may be used in the projectile 20.

Figure 3:
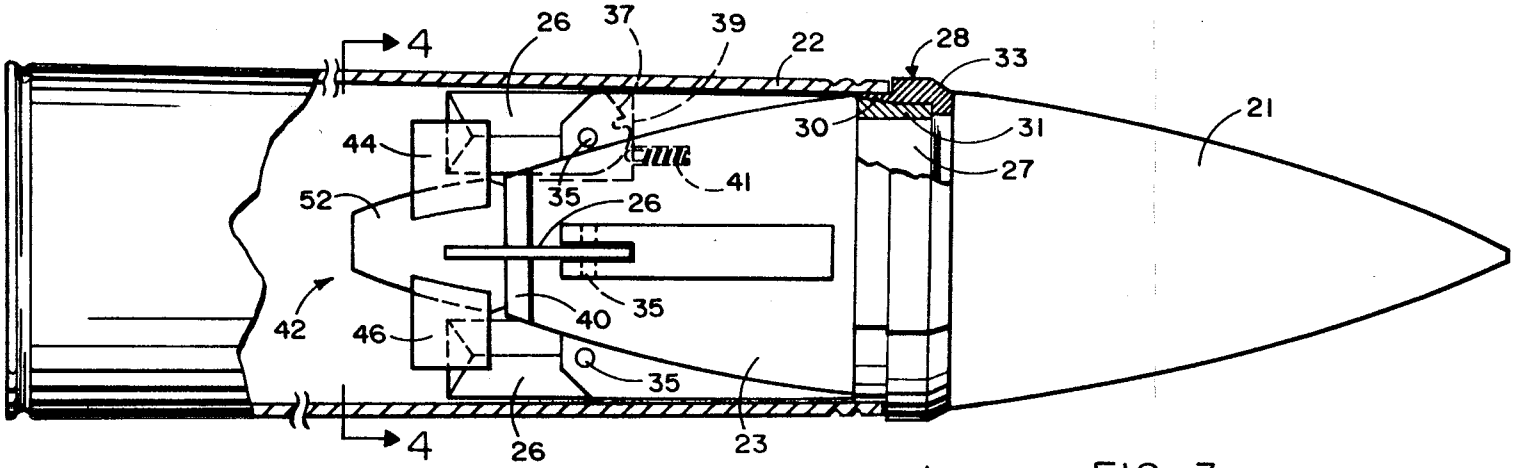
FIG. 3 is a side elevation of the inventive projectile prior to launch.

Referring now to FIG. 3 (in which, as in all of FIGS. 2 through 6, the diameter of the projectile 20 is greatly exaggerated with respect to its length for drawing clarity), it will be noted that the projectile 20 is equipped with an obturation seal ring 28 of low-friction plastic material, which is held in place on the projectile 20 by the engagement of the casing 22 with its flange 30. The obturation seal ring 28 engages a sleeve 31 which makes a loose sliding contact with the body 27 of projectile 20. When the round 24 is fired, the rifling on the gun barrel engages the obturation seal ring 28 and imparts to it a spin on the order of 50,000 rpm. The sliding engagement of the sleeve 31 with the projectile body 27 transmits some of the spin to the projectile but absorbs most of it, so that the projectile 20 has a muzzle spin rate of about 1,200–2,400 rpm.

The obturation seal ring 28 is preferably formed in several sections, e.g. three sections of 120° each. When the projectile 20 clears the barrel of the gun, these sections (no longer restrained by the casing or the barrel) part and fly off. This prevents the protruding portion 33 of ring 28 from breaking the surface flow of air along the projectile 20 and causing drag.

Figure 4:
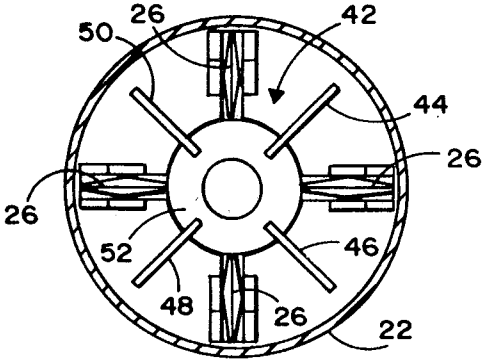
FIG. 4 is an end elevation of the inventive projectile prior to launch.

Prior to the firing of the round, the stabilizing fins 26 are folded against the afterbody of the projectile 20 so as to fit into the casing 22. In this position, the stabilizing fins 26 lie between the guidance fins 44, 46, 48, 50 and thus prevent any rotation of the fin assembly 42 with respect to the projectile body (FIG. 4).

Figure 5:
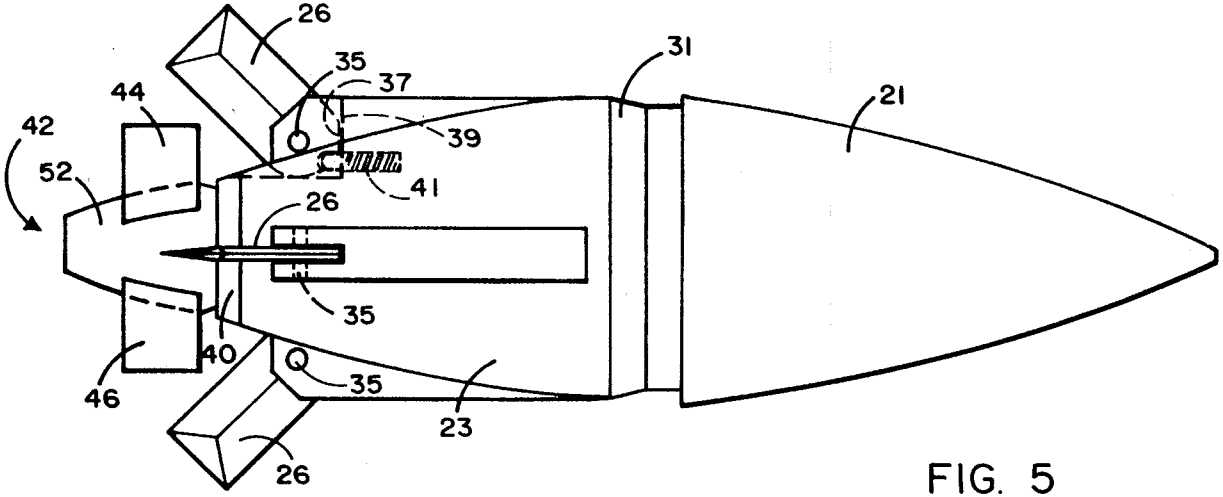
FIG. 5 is a side elevation of the inventive projectile after launch.

When the round leaves the barrel, the combination of gas pressure and spin kicks the stabilizing fins 26 outwardly about pivot axis 35 until their surface 37 abuts the surface 39 of the projectile. The detent 41 locks the stabilizing fins 26 in that position (FIG. 5). The aerodynamic design of the stabilizing fins 26 is conventional for minimum drag.

Figure 6:
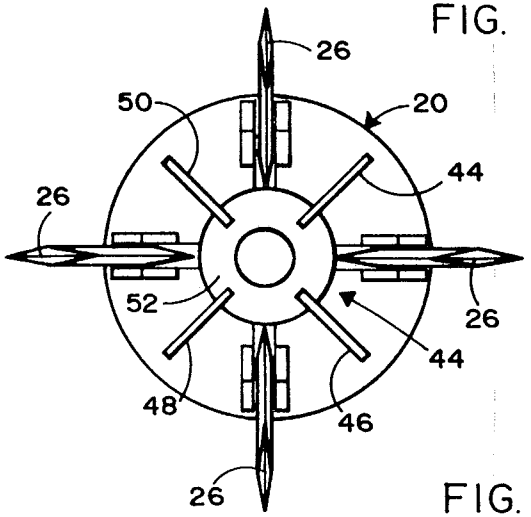
FIG. 6 is an end elevation of the inventive projectile after launch.

With the stabilizing fins 26 thus extended, the guidance fin assembly 42 is able to rotate with respect to the projectile body (FIGS. 5 and 6). At this time, the guidance system's de-spin apparatus (i.e. motors 34, 36, FIG. 7*b*) goes into action and rotates the fin assembly 42 and its mounting base 40 with respect to the projectile 20 at its spin rate but in the opposite direction. Consequently, the guidance fins 44, 46, 48, 50 maintain a fixed orientation in space regardless of the projectile's spin. This fixed spatial orientation greatly simplifies the attitude control of the guidance fin assembly 42, because the attitude of assembly 42 is then independent of the roll position of projectile 20. Therefore, the guidance fins are active full time (which reduces their required size), and they require less power (because their response time can be relatively slow).

This is a considerable advantage over prior art guidance fin assemblies which are not de-spun, and which must therefore be continuously re-adjusted during each rotation of the projectile.

The electronics package 32 controls by conventional means, the de-spin motor 34, the pivot motor 36, and the translation motor 38. When the projectile 20 leaves the barrel of gun 12, de-spin motor 34 and pivot motor 36 are actuated in synchronism with each other to de-spin the fin assembly 42 and maintain it in a generally upright position. When guidance instructions (e.g. "pull 5 g's to the left") are received by the projectile 20, the electronics package 32 actuates pivot motor 36 and translation motor 38 to nutate the fin assembly 42 until accelerometers within the electronics package 32 determine that the instructions have been carried out.

The motors 34, 36, 38 may be stepper motors whose rotational speed can be very accurately controlled and adjusted within very small tolerances. Once established within the barrel of the gun, the spin rate varies only slowly during the flight of the projectile, particularly because of the bias of the stabilizing fins. Therefore, after the initial run-up, the de-spin motor 34 needs only slow and minor speed adjustments.

As long as no guidance is required, the motors 34 and 36 rotate in synchronism with each other and together function to de-spin the guidance fin mounting base 40, its stem 45, and the guidance fin assembly 42. In this condition, the guidance fin assembly 42 acts like the empennage of an aircraft and holds the projectile 20 on a steady course.

The guidance fin assembly 42 of this invention is a unique guidance structure which is capable of withstanding the crushing breech pressures (50–60,000 PSI) and acceleration forces (50,000 g) to which gun-fired projectiles are exposed. Unlike conventional guidance surfaces which are independently pivotable, the assembly 42 of this invention uses a nutatable hub 52 with fixed guidance fins 44, 46, 48, 50 which are integrally formed with hub 52 (FIG. 8) and are therefore exceedingly strong. In addition to carrying the guidance fins, the hub 52 forms an aerodynamic continuation of the projectile body. This allows a considerable reduction of the base diameter of the projectile 20, with a consequent major reduction of base drag.

The hub 52 has an interior spherical surface 54 which engages a ball 56 forming the aft end of the de-spun guidance fin mounting base 40. The entire fin assembly 42 can thus nutate in any direction about the center of ball 56.

Nutation within a longitudinal vertical plane (for controlling pitch by way of fins 46 and 50) is achieved by a pin 58 whose generally spherical head 60 engages a recess 62 in the hub 52. The pin 58 is mounted on a sleeve 59 which can pivot about control rod 70 but cannot move axially with respect thereto. The combination of the pivotability of sleeve 59 and the spherical shape of the head 60 enable the pin 58 to follow any nutation of hub 52 in a horizontal plane by crank pin 64 while maintaining hub 52 steady in a longitudinal vertical plane.

Nutation in a transverse horizontal plane (for controlling yaw by way of fins 44 and 48) is accomplished by a crank pin 64 on control rod 70 engaging a slot 66 in a dowel 68 positioned within the hub 52. The dowel can turn within the hub 52. The slot 66 accommodates nutation of the hub 52 in a longitudinal vertical plane upon translation of control rod 70, while the turning ability of dowel 68 maintains the slot 66 in alignment with crank pin 64 during nutation of the hub 52 in a horizontal plane.

It will thus be seen, by examining FIGS. *7a*, *7b*, 8 and 9, that the pitch of the projectile 20 can be controlled by translating control rod 70 horizontally in FIG. 6, and that the yaw of the projectile 20 can be controlled by pivoting the control rod 70 about its horizontal axis 72.

No pivoting or translation of the control rod 70 occurs as long as the motors 34 and 36 rotate at the same speed, and motor 38 is stopped. If a pitch adjustment is now desired, an appropriate signal is generated by the electronics 32 in a conventional manner to rotate translation motor 38 in an appropriate direction. This rotation causes the screw-threaded sleeve 74 to pull the control rod 70 to the right or to push it to the left in FIGS. *7a* and *7b* depending on the direction in which translation motor 38 rotates. The sleeve 74 is held against rotation with respect to the projectile body 27 by a guide slot 76. The longitudinal motion of control rod 70 is transmitted to pin 58 which causes the fin assembly 42 to nutate in such a manner as to steer the projectile 20 up or down.

Yaw control of the projectile 20 is accomplished by generating an appropriate electronic signal which causes the pivot motor 36 to vary its speed with respect to the de-spin motor 34. The pivot motor 36 engages control rod 70 for pivotal movement regardless of its axial position through a sliding spline arrangement involving gear teeth 78 and 80, which are horizontally slidable with respect to each other. Any speed differential between de-spin motor 34 and pivot motor 36 therefore results in a pivotal movement of control rod 70 with respect to the fin assembly shaft 40. This pivotal movement of control rod 70 turns the eccentric crank pin 64 in such a way as to nutate the fin assembly 42 in a horizontal plane (FIG. 9), thus steering the projectile to the left or to the right.

Inasmuch as the translation and pivoting of control rod 70 are independent of one another, the projectile 20 can be guided in any direction by a combination of translating and pivoting motions of the control rod 70. As a practical matter, the nutation of hub 52 can be quite limited; a ten-degree nutation in any direction is sufficient to pull 9 g's—a very sharp turn.

It will be seen that the present invention provides a simple and rugged guidance mechanism for a projectile which requires relatively little power and relatively unsophisticated electronics, and which can readily be incorporated in standard-sized and standard-shaped ammunition for use in existing weapons.

I claim:

1. A guided spinning projectile, comprising:

(a) a body;

(b) a nutatable guidance fin assembly mounted on the aft end of said body;

(c) control rod means for nutating said fin assembly; and (d) de-spinning means for rotating said fin assembly and control rod means at a rate equal to the spin of the projectile but in the opposite direction.

2. A guided spinning projectile, comprising:

(a) a body;

(b) a nutatable guidance fin assembly mounted on the aft end of said body;

(c) control rod means for nutating said fin assembly;

(d) de-spinning means for rotating said fin assembly and control rod means at a rate equal to the spin of the projectile but in the opposite direction; and (e) said control rod means including a single control rod which is both pivotable and axially translatable with respect to said fin assembly.

3. The projectile of claim 2, in which said de-spinning means include a de-spin motor, and said projectile further comprises:

(e) pivot control motor means for pivoting said control rod means with respect to said fin assembly; and (f) translation control motor means for axially translating said control rod means with respect to said fin assembly.

4. The projectile of claim 3, in which said pivot and translation control motor means rotate substantially in synchronism with said de-spin motor, and control said control rod means by varying their respective rotational speeds with respect to the rotational speed of said de-spin motor.

5. The projectile of claim 1, in which said fin assembly is an integral piece.

6. A guidance system for a spinning projectile, comprising:

(a) guidance fin means movable with respect to the body of said projectile for guiding said projectile; and (b) de-spin means for de-spinning said fin means so as to maintain a substantially constant attitude with respect to the ground during the flight of said projectile;

(c) said guidance fin means being mounted for nutation in a pair of orthogonal planes.

7. A guidance system for a spinning projectile, comprising:

(a) guidance fin means movable with respect to the body of said projectile for guiding said projectile; and (b) de-spin means for de-spinning said fin means so as to maintain a substantially constant attitude with respect to the ground during the flight of said projectile;

(c) said de-spin means including a de-spun, substantially spherical fin assembly mounting base, said fin means including a hub nutatably mounted on said base; and which further comprises control means for nutating said hub in a pair of orthogonal planes.

8. The guidance system of claim 7, in which said fin means are integrally formed with said hub.

9. The guidance system of claim 8, in which said fin means include two pairs of fins positioned at right angles to each other.

* * * * *